US005774151A

United States Patent [19]

Sugitani et al.

[11] Patent Number: 5,774,151

[45] Date of Patent: Jun. 30, 1998

[54] LIQUID EJECTING HEAD, LIQUID EJECTING APPARATUS AND METHOD OF PRODUCING SAID LIQUID EJECTING HEAD

[75] Inventors: Hiroshi Sugitani, Machida; Masaki Inaba, Kawasaki; Masami Ikeda; Yutaka Koizumi, both of Yokohama; Masami Kasamoto, Ayase; Tsuyoshi Orikasa, Musashimurayama; Makiko Kimura, Sagamihara; Toshio Kashino, Chigasaki; Seiichiro Karita, Yokohama; Haruhiko Terai, Yokohama; Akira Goto, Yokohama, all of Japan

[73] Assignee: Canon Kabushiki Kaisha, Tokyo, Japan

[21] Appl. No.: 927,636

[22] Filed: Sep. 11, 1997

Related U.S. Application Data

[63] Continuation of Ser. No. 693,541, Aug. 7, 1996, abandoned, which is a continuation of Ser. No. 593,475, Jan. 29, 1996, abandoned, which is a continuation of Ser. No. 175,514, Dec. 30, 1993, abandoned.

[30] Foreign Application Priority Data

| | | | |
|---|---|---|---|
| Jan. 1, 1993 | [JP] | Japan | 5-014415 |
| Dec. 17, 1993 | [JP] | Japan | 5-318737 |

[51] Int. Cl.[6] ..... B41J 2/05

[52] U.S. Cl. ..... 347/63; 347/42; 29/890.1

[58] Field of Search ..... 347/63, 64, 65, 347/20, 42; 29/890.1

[56] References Cited

U.S. PATENT DOCUMENTS

| | | |
|---|---|---|
| 4,313,124 | 1/1982 | Hara . |
| 4,345,262 | 8/1982 | Shirato et al. . |
| 4,392,907 | 7/1983 | Shirato . |
| 4,412,224 | 10/1983 | Sugitani . |
| 4,417,251 | 11/1983 | Sugitani . |
| 4,437,100 | 3/1984 | Sugitani et al. . |
| 4,459,600 | 7/1984 | Sato et al. . |
| 4,463,359 | 7/1984 | Ayata et al. . |

(List continued on next page.)

FOREIGN PATENT DOCUMENTS

| | | | |
|---|---|---|---|
| 627931 | 6/1991 | Australia | B41J 2/05 |
| 0214733 | 3/1987 | European Pat. Off. | B41J 3/04 |
| 0419193 | 3/1991 | European Pat. Off. | B41J 2/05 |
| 0469916 | 2/1992 | European Pat. Off. | B41J 2/16 |
| 54-56847 | 5/1979 | Japan | B41M 5/26 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 61-255864 | 11/1986 | Japan | B41J 3/04 |

OTHER PUBLICATIONS

Jou, J.H. et al., "An Analysis of Thermal Stresses in a Multilayer Thin Film Printhead", Thin Solid Films, 30 Jun. 1991, Lausanne, CH. pp. 253–265.

*Primary Examiner*—Joseph W. Hartary

*Attorney, Agent, or Firm*—Fitzpatrick, Cella, Harper & Scinto

[57] ABSTRACT

A liquid ejecting head for a liquid ejecting apparatus for performing a recording operation by ejecting liquid from the liquid ejecting head includes as essential components a base plate having a plurality of liquid ejecting elements, and a grooved member having a plurality of grooves formed thereon corresponding to the liquid ejecting elements. The grooved member is connected to the base plate and composed of a grooved element and a supporting member. A liquid ejecting apparatus operable for performing a recording operation includes as essential components a liquid ejecting head of the foregoing type and a signal supplying unit for supplying,a series of signals to the liquid ejecting head for activating a plurality of liquid ejecting elements. A method of producing a liquid ejecting head of the foregoing type is practices by way of the steps of preparing a base plate having a plurality of liquid ejecting elements, forming a, plurality,of supporting portions on a supporting member, forming a grooves member including a grooved element, and then connecting the grooved element to a resin member constituting a part of the grooved member via the supporting portions.

42 Claims, 11 Drawing Sheets

U.S. PATENT DOCUMENTS

| | | | |
|---|---|---|---|
| 4,499,480 | 2/1985 | Takatori | 347/42 |
| 4,509,063 | 4/1985 | Sugitani et al. . | |
| 4,521,787 | 6/1985 | Yokota et al. . | |
| 4,558,333 | 12/1985 | Sugitani et al. . | |
| 4,559,543 | 12/1985 | Toganoh | 347/42 X |
| 4,608,577 | 8/1986 | Hori . | |
| 4,609,427 | 9/1986 | Inamoto et al. . | |
| 4,611,219 | 9/1986 | Sugitani et al. . | |
| 4,635,077 | 1/1987 | Itoh | 347/65 |
| 4,646,110 | 2/1987 | Ikeda et al. . | |
| 4,666,823 | 5/1987 | Yokota et al. | 430/320 |
| 4,698,645 | 10/1987 | Inamoto . | |
| 4,723,129 | 2/1988 | Endo et al. | 347/56 |
| 4,740,796 | 4/1988 | Endo et al. | 347/56 |
| 4,752,787 | 6/1988 | Matsumoto et al. . | |
| 4,929,964 | 5/1990 | Sato et al. . | |
| 4,994,825 | 2/1991 | Saito et al. . | |
| 5,017,947 | 5/1991 | Masuda . | |
| 5,235,351 | 8/1993 | Koizumi . | |

LIQUID EJECTING HEAD, LIQUID EJECTING APPARATUS AND METHOD OF PRODUCING SAID LIQUID EJECTING HEAD

This application is a continuation of applicant Ser. No. 08/693,541 filed Aug. 7, 1996, which was a continuation of application Ser. No. 08/593,475 filed Jan. 29. 1996, which was a continuation of application Ser. No. 08/175,514 filed Dec. 30, 1993, all now abandoned.

FIELD OF THE INVENTION

The present invention relates generally to a liquid ejecting head adapted to eject liquid for performing a recording operation therewith, a liquid ejecting apparatus having a liquid ejecting head of the foregoing type mounted thereon, and a method of producing a liquid ejecting head of the foregoing type. More particularly, the present invention relates to a liquid ejecting head preferably employable for a printer, an electronic copying apparatus, a facsimile apparatus, a printing/dyeing apparatus or the like, a liquid ejecting apparatus capable of mounting a liquid ejecting head of the foregoing type thereon, and a method of producing a liquid ejecting head of the foregoing type for performing a recording operation by operating the liquid ejecting apparatus.

DESCRIPTION OF THE RELATED ART

A liquid eject recording method of performing a recording operation by ejecting recording liquid such as ink or the like from an ejecting port in the form of droplets by utilizing thermal energy and then allowing the ejected recording liquid droplets to adhere to a recording medium such as printing paper, a plastic sheet, a cloth or the like is hitherto known. Since the liquid eject recording method can be practiced without any impact induced during each recording operation, it has many advantages that few noisy sound is generated from the liquid ejecting head and the recording apparatus, any particular restrictive condition is not specified for the recording medium, and a color recording operation can easily be achieved with the recording apparatus by practicing the foregoing recording method.

In addition, an apparatus for practicing a liquid eject recording method of the foregoing type, i.e., a liquid eject recording apparatus likewise has many advantages that it is comparatively simple in structure, a plurality of liquid ejecting nozzles can be arranged on the recording apparatus at a high density, and the recording apparatus can comparatively easily be operated at a higher speed. In the circumstances as mentioned above, sincere attention has been paid to the liquid eject recording method, and a variety of research and development activities have been heretofore conducted for improving the properties of the liquid eject recording method. It is well known for any expert in the art that several types of liquid eject recording apparatuses each having a liquid eject recording method of the foregoing type employed therefor have been shipped to a commercial market for practical use.

To facilitate understanding of the present invention, a typical conventional liquid ejecting head will be described below with reference to FIGS. 15, 16 and 17.

FIG. 15 shows by way of perspective view the structure of a conventional liquid ejecting head employable for a recording apparatus of the foregoing type. For the purpose of simplification of illustration, a grooved member having a plurality of liquid paths formed thereon is shown in such a manner that it is disconnected from a base plate. As shown in FIG. 15, the liquid ejecting head is generally composed of a plurality of ejecting ports 105 each serving to eject recording liquid such as ink or the like, a plurality of liquid paths formed corresponding to the ejecting ports 105, a liquid chamber (not shown) for supplying the recording liquid to the respective liquid paths, a plurality of liquid ejecting elements 107 such as electro-pressure converting elements or elecrothermal converting elements each serving to apply thermal energy to the recording liquid for ejecting the latter from each respective ejecting port 105 (exemplified by electrothermal converting elements in the shown case), and a base plate 111 for the liquid ejecting head having a plurality of conductors 104 connected thereto so as to supply a series of electrical signals to the respective liquid ejecting elements 107.

The base plate 111 having a plurality of electrothermal converting elements used as the liquid ejecting elements 107 for the liquid ejecting head is generally constructed such that a plurality of heat generating resistor layers as the liquid ejecting elements 107 are placed on a substrate 103 and a plurality of conductors 104 made of a metallic material having excellent electrical conductivity is deposited on each liquid ejecting element 107 to form an electrothermal converting element for the liquid ejecting head.

A plate-shaped member made of single crystal silicon, polycrystal silicon, glass, ceramics or metallic material is often employed as a material for the substrate 103 constituting the base plate 111 for the liquid ejecting head.

On the other hand, a plurality of liquid paths are formed by connecting the grooved member 102 including a plurality of liquid path walls 101 defining the respective liquid paths to the base plate 111, whereby a desired liquid ejecting head can be obtained with these components. Conventionally, a plate-shaped member made of glass or metallic material has been employed as a material for the grooved member 102.

However, a plurality of small-sized grooves should be formed on the plate-shaped member made of the aforementioned kind of material by employing a cutting process or an etching process. In the case that each groove is formed by employing the cutting process, there may arise a malfunction that the inner wall surface defining each liquid path becomes excessively coarse. On the other hand, in the case that each groove is formed by employing the etching process, there may arise a malfunction that each liquid path is warped due to irregularity of an etching rate appearing across the length of the groove, resulting in the liquid ejecting properties of the liquid ejecting head readily fluctuating after completion of the production of the liquid ejecting head. Another problem is such that when the cutting process is employed, crack or fracture readily occurs with the plate-shaped member serving as a grooved member 102, resulting in a yielding rate of the grooved member 102 being undesirably reduced.

In view of the foregoing fact, various kinds of resin materials are practically used as a material constituting the grooved member 102, and each groove in the grooved member 102 is formed by way of steps of exposing, developing and patterning. Otherwise, each groove is formed by pouring the molten resin in a molding die to form a grooved member 102.

However, it has been found that the liquid ejecting head constructed in the above-described manner has the following problems to be solved.

In recent years, as recording apparatuses each having a liquid eject recording system employed therefor are increasingly put in use, they are practically used in a various working environment. In the case that each liquid ejecting recording system is used not only in a low temperature environment but also in a high temperature environment, it has been found that a few problems are left unsolved, one of them being that liquid ejection fluctuates due to the ejection of the recording liquid in the curved state, other one being that liquid ejection can not be achieved in the foregoing temperature environment and another one being that the recording liquid is not ejected from some ejecting ports.

FIGS. 16 and 17 schematically show by way of horizontal sectional view the structure of a conventional liquid ejecting head, especially, a liquid ejecting head having a large length wherein FIG. 16 schematically shows the operative state of the liquid ejecting head in a room temperature environment and FIG. 17 schematically shows the operative state of the liquid ejecting head in a high temperature environment. In FIGS. 16 and 17, reference numeral 101 designates a liquid path wall constituting a liquid path 106, reference numeral 102 designates a liquid ejecting port for ejecting liquid therefrom, reference numeral 106 designates a liquid path, and reference numeral 107 designates a liquid ejecting element such as an electrothermal converting element, a piezoelectric element or the like for generating thermal energy to be utilized for the purpose of liquid ejection.

As long as the liquid ejecting head is held at the temperature approximately equal to that at the time of production of the liquid ejecting head, i.e., at the room temperature, a distance A between the liquid path wall 101 defining each liquid path 106 and the liquid ejecting element 107 is substantially equal to a distance B between the liquid path wall 101 defining an adjacent liquid path 106 and the liquid ejecting element 107 as shown in FIG. 16. Thus, since the thermal energy generated by the liquid ejecting element 107 is sufficiently applied to liquid in the liquid path 106, the recording liquid can correctly be ejected from the respective liquid ejecting ports 102.

However, in the case that the environmental working temperature of the liquid ejecting head is elevated or in the case that the temperature of the liquid ejecting head itself is elevated, there arises a malfunction that the liquid ejecting element 107 is relatively dislocated in the liquid path 106 as if it moves away from the left-hand liquid path wall 101 and toward the right-hand liquid path wall 101 on the left-hand side of the liquid ejecting head as shown in FIG. 17. In this case, since the distances A and B between the liquid path wall 101 and the liquid ejecting element 107 are increasingly changed toward the opposite ends of the liquid ejecting head as represented by A' and B', this causes the position where the thermal energy to be utilized for liquid ejection is applied to recording liquid in each liquid path 106 to vary. Consequently, the recording liquid is incorrectly ejected from the liquid ejecting port 102 in the curved state or ejected liquid droplets are shot onto a recording medium such as recording paper, a cloth or the like at a low accuracy.

In the case that each liquid ejecting element 102 is largely dislocated in the liquid path 106 at the opposite ends of a grooved member as illustrated in FIG. 17, the liquid ejecting element 102 is located adjacent to the lower part of the liquid path wall 101, resulting in the thermal energy to be utilized for liquid ejection failing to be sufficiently applied to the recording liquid in the liquid path 106. Thus, there may arise a malfunction that the recording liquid is incorrectly ejected from the respective liquid ejecting ports 102.

The foregoing tendency of incorrect liquid ejection is remarkably recognized with a so-called bubble jet recording head adapted to perform a recording operation by ejecting liquid such as ink or the like by utilizing thermal energy. Particularly, this tendency of incorrect liquid ejection is more remarkably recognized with a liquid ejecting head having a long length for which development activities have been conducted in recent years for performing each recording operation at a higher speed. In the circumstances as mentioned above, to assure that each recording operation can be performed so as to obtain recorded images each having a high quality with a recording apparatus not only at a high speed but also at a high accuracy, the foregoing tendency of incorrect liquid ejection becomes a particularly serious problem to be solved.

SUMMARY OF THE INVENTION

The present invention has been made in consideration of the foregoing background.

An object of the present invention is to provide a liquid ejecting head which makes it possible to stably record images at an inexpensive cost without any possibility that the aforementioned problems inherent to the conventional liquid ejecting head appear not only in a low temperature environment but also in a high temperature environment, a recording apparatus which makes it possible to mount a liquid ejecting head of the foregoing type thereon, and a method of producing a liquid ejecting head of the foregoing type at an inexpensive cost by way of simple steps without any possibility that the aforementioned problems inherent to the conventional method appear.

Another object of the present invention is to provide a liquid ejecting head such as a long liquid ejecting head or the like, especially, a long liquid ejecting head adapted to perform a recording operation by utilizing thermal energy and a recording apparatus capable of allowing a liquid ejecting head of the foregoing type to be mounted thereon wherein the aforementioned problems inherent to the conventional liquid ejecting head are entirely eliminated, and moreover, images each having a high quality can stably be recorded on a recording medium such as recording paper, cloth or the like at a high speed.

Further object of the present invention is to provide a method of producing a liquid ejecting head of the foregoing type wherein the aforementioned problems inherent to the conventional method are entirely eliminated, and moreover, the liquid ejecting head can be produced by way of simple steps.

According to a first aspect of the present invention, there is provided a liquid ejecting head adapted to eject liquid for performing a recording operation therewith, wherein the liquid ejecting head comprises a base plate having a plurality of liquid ejecting elements for ejecting liquid, and a grooved member having a plurality of grooves constituting a plurality of liquid paths formed thereon corresponding to the liquid ejecting elements, the grooved member being connected to the base plate and composed of a grooved element having the grooves formed thereon and a supporting member for supporting the grooved element thereon.

In addition, according to a second aspect of the present invention, there is provided a liquid ejecting head adapted to eject liquid for performing a recording operation therewith, wherein the liquid ejecting head comprises a base plate having a plurality of liquid ejecting elements for ejecting liquid, a supporting member, and a grooved member having the supporting member embedded therein, the grooves member being composed of a resin member having a plurality of grooves constituting a plurality of liquid paths formed thereon corresponding to the liquid ejecting elements.

It is desirable that the supporting member includes a plurality of supporting portions in the form of opening portions and that a resin layer on the grooved member side is connected to a resin layer located opposite to the first-mentioned resin layer with the aid of the supporting portions.

Alternatively, the supporting member likewise includes a plurality of supporting portions but a resin layer is arranged only on one side of the grooved member. Also in this case, the resin layer is connected to the grooved element with the aid of the supporting portions.

In practice, the supporting member has a thermal expansion coefficient approximately equal to that of the base plate much more than that of the grooved plate.

It is recommendable that the liquid ejecting head is prepared in the form of a full line type head.

According to a third aspect of the present invention, there is provided a recording apparatus, wherein the recording apparatus comprises a liquid ejecting head as defined according to the first aspect of the present invention or the second aspect of the same and a signal supplying unit for supplying a series of signals to the liquid ejecting head so as to activate a plurality of liquid ejecting elements.

According to a fourth aspect of the present invention, there is provided a method of producing a liquid ejecting head including a base plate having a plurality of liquid ejecting elements for ejecting liquid and a grooved member having a plurality of grooves each constituting a plurality of liquid path formed thereon corresponding to the liquid ejecting elements, the grooves member being connected to the base plate, wherein the method comprises a step of preparing a base plate having the liquid ejecting elements, a step of forming a plurality of supporting portions on a supporting member, a step of forming the grooved member by forming a grooved element on one side of the supporting member, forming a resin layer on other side of the same, and then connecting the grooved element to the resin member with the aid of the supporting portions, and a step of connecting the base plate to the grooved member.

In addition, according to a fifth aspect of the present invention, there is provided a method of producing a liquid ejecting head including a base plate having a plurality of liquid ejecting elements for ejecting liquid and a grooved member having a plurality of grooves each constituting a plurality of liquid path formed thereon corresponding to the liquid ejecting elements, the grooved member being connected to the base plate, wherein the method comprises a step of preparing a base plate having the liquid ejecting elements, a step of preparing a supporting member, and a step of covering the supporting member with a resin material and integrally forming the grooves each constituting a liquid path in the resin material.

It is desirable that the method further includes a step of allowing the supporting member to be subjected to surface treatment so as to improve adhesiveness properties of the supporting member relative to the resin material.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 17 shows the positional offset of the grooved member from the base plate in high temperature environment.

DETAILED DESCRIPTION OF THE PREFERRED EMBODIMENTS

The present invention will now be described in detail hereinafter with reference to the accompanying drawings which illustrate several preferred embodiments thereof. And the term "recording" also includes textile printing and the like in the present invention.

Here, it should be noted that the inventors conducted a variety of research and development activities, and as a result derived from the research and development activities, they have reached a technical concept that a supporting member is connected to a grooved member having a plurality of liquid path walls formed therein in order to attenuate the strain arising attributable to a difference between the grooved member and the base plate in respect of a thermal expansion coefficient.

Figure 1:
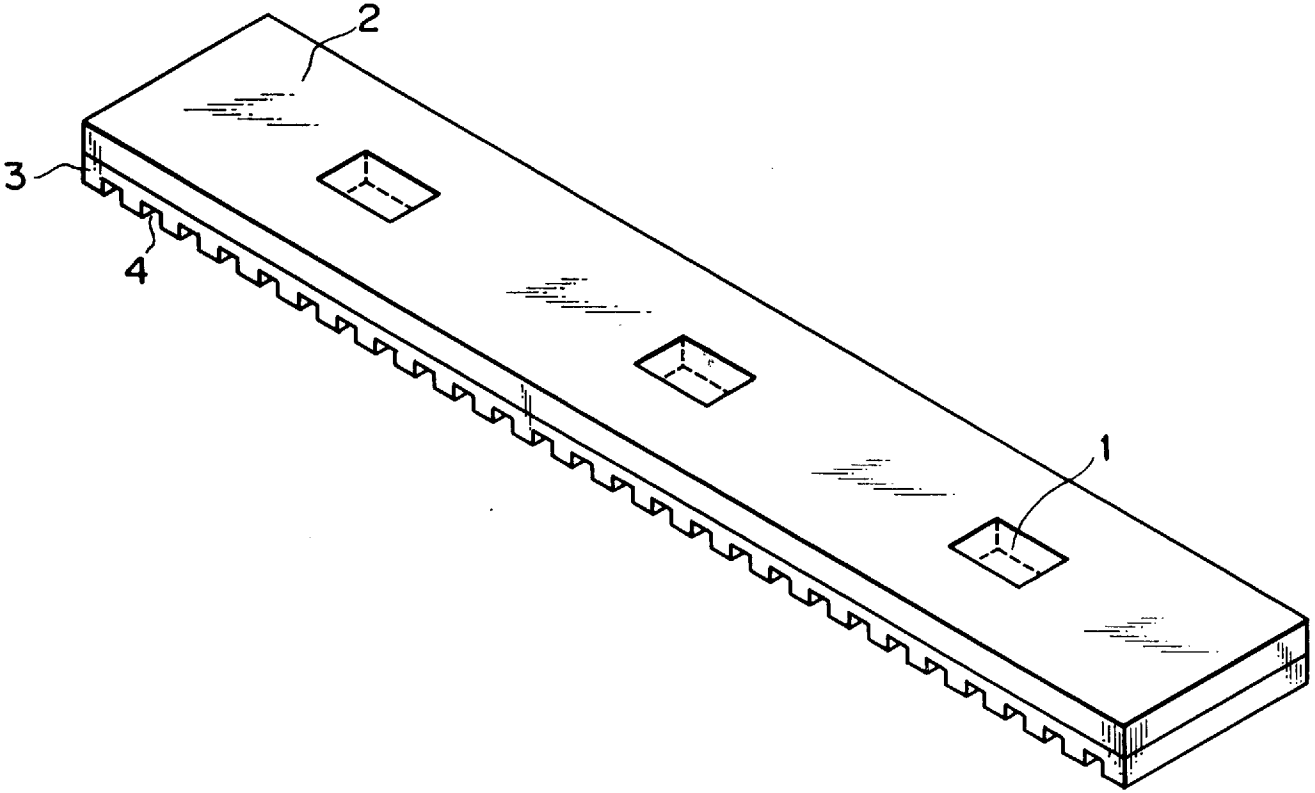
FIG. 1 is a perspective view of a grooved member constituting a liquid ejecting head constructed according to a first embodiment of the present invention.

FIG. 1 shows by way of perspective view the structure of a grooved member constituting a liquid ejecting head constructed according to a first embodiment of the present invention. The grooved member is constructed such that a grooved plate (grooved element) 3 made of a synthetic resin and having a plurality of grooves each serving as a liquid path 4 formed thereon is connected to a supporting member 2.

Any type of synthetic resin is acceptable as a material for the grooved plate 3, provided that it is proven that a plurality of grooves can exactly be formed. In this connection, it is desirable that the resin employable for the grooved plate 3 exhibits excellent properties in respect of mechanical strength, dimensional stability and resistibility against recording liquid. It is desirable that an epoxy resin, an acrylic resin, a diglycol-dialkylcarbonate resin, an unsaturated polyester resin, a polyurethane resin, a polyimide resin, a melamine resin, a phenol resin, a urea resin or the like is employed as a material for the grooved plate 3. Especially, it is desirable from the viewpoint of moldability and resistibility against recording liquid that a polysulfone resin, a polyether-sulfone resin or the like is employed as a material for the grooved plate 3.

Since the grooved plate 3 having a plurality of liquid, path walls each defining a liquid path 4 formed thereon is molded of a synthetic resin but any groove is not formed on the supporting member 2, the inner wall surface of the liquid path 4 does not become coarse and no crack arises on the liquid path 4. Consequently, a liquid ejecting head having excellent resistibility against recording liquid can be produced by using the supporting member 2 and the grooved plate 3 assembled together in the above-described manner.

The supporting member 2 is constructed of a material, e.g., glass, alumina, sapphire, silicon, metallic material or the like each of which has a coefficient of thermal expansion approximately equal to or more preferably equal to that of the base plate having a plurality of liquid ejecting elements disposed thereon.

In the case that the synthetic resin employed for molding the grooved plate 3 has poor adhesiveness to the supporting member 2 having a low thermal expansion coefficient, it is anticipated that the supporting member 2 fails to exhibit its own function due to an occurrence of dislocation of the grooved plate 3 relative to the supporting member 2 when the temperature of the recording head varies, like the aforementioned case that the grooved member is dislocated from the base plate. In view of the foregoing malfunction, in this embodiment, three opening portions 1 each serving as a supporting portion are formed through the supporting member 2 so that a part of the grooved plate 3 is inserted into each of the opening portions 1. The formation of the opening portions 1 in that way can suppress thermal expansion or contraction of the grooved plate 3, and moreover, can prevent liquid paths 4 from being positionally offset from liquid ejecting elements when the temperature of the liquid ejecting heads varies. In this embodiment, three supporting portions are arranged on the supporting member 2 in the form of opening portions 1. However, the present invention should not be limited only to the arrangement of three supporting portions but the number of supporting portions may arbitrarily be determined, provided that it is assured that the aforementioned dislocation or positional offset can effectively be suppressed.

Figure 2:
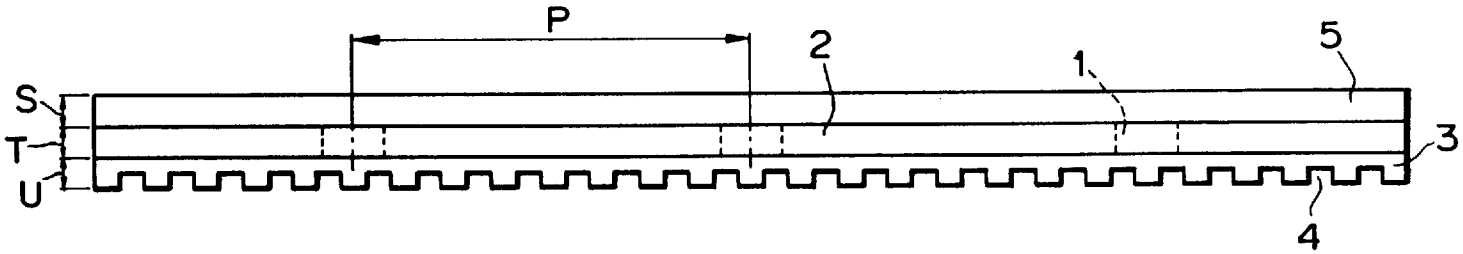
FIG. 2 is a side view of a grooved member constituting a liquid ejecting head constructed according to a second embodiment of the present invention.

FIG. 2 shows by way of side view the structure of a grooved member constituting a liquid ejecting head constructed according to a second embodiment of the present invention. Referring to the drawing, the grooved member is shown as viewed in the liquid ejecting direction.

In this embodiment, a resin layer 5 is placed on a supporting member 2, and a grooved plate 3 is connected to the resin layer 5 through the opening portions 1 interposed therebetween. Since the resin layer 5 is placed on the upper surface of the supporting member 2 located opposite to the surface of the same having the grooved plate 3 connected thereto so that these components are connected to each other via the opening portions 1, an occurrence of dislocation or positional offset as mentioned above attributable to the variation of the temperature of the liquid ejecting head can reliably be suppressed. Thus, a liquid ejecting head having excellent properties of recording liquid ejection can be obtained by using the aforementioned components.

It is acceptable that the resin layer 5 is placed on the supporting member 2 at least within the range where the supporting member 2 is connected to the grooved plate 3 via the opening portion 1. However, in the case that the resin layer 5 is placed on the supporting member 2 on the opposite side to the grooved plate 3 with a small area and the liquid ejecting head is designed with a larger length, there is a possibility that warpage occurs with the grooved plate 3. In view of the foregoing possibility, it is desirable that the resin layer 5 is placed on the supporting member 2 with the substantially same area as that of the grooved plate 3.

At this time, when a thickness U of the grooved plate 3 is dimensioned to be substantially equal to a thickness S of the resin layer 5, there is few possibility that warpage occurs with the grooved plate 3. To maintain excellent recording liquid ejecting properties of the liquid ejecting head, it is desirable that a difference between the thickness U of the grooved plate 3 and the thickness S of the resin layer 5 is set to 60 $\mu$m or less at the position where each liquid ejecting element is disposed in a liquid path 4 (i.e., on the downstream side of the liquid path).

Also in this embodiment, three supporting portions are arranged on the supporting member 2 in the form of opening portions 1. However, the present invention should not be limited only to the three opening portions 1. Alternatively, the number of the opening portions 1 may arbitrarily be determined. It is acceptable that a pitch P between adjacent opening portions 1 is adequately determined, provided that it is assured that there does not arise a malfunction that recording liquid is incorrectly ejected or it fails to be ejected within the temperature range from a room temperature to a working temperature under a condition that the liquid ejecting head is practically used. With the liquid ejecting head produced at the room temperature of 20° C., it is preferable that the pitch P is set to be smaller than 37 mm in consideration of the working temperature range of −50° C. to +40° C. In the case that a higher quality of image is required, it is more preferable that the pitch P is set to be smaller than 20 mm.

Figure 3:
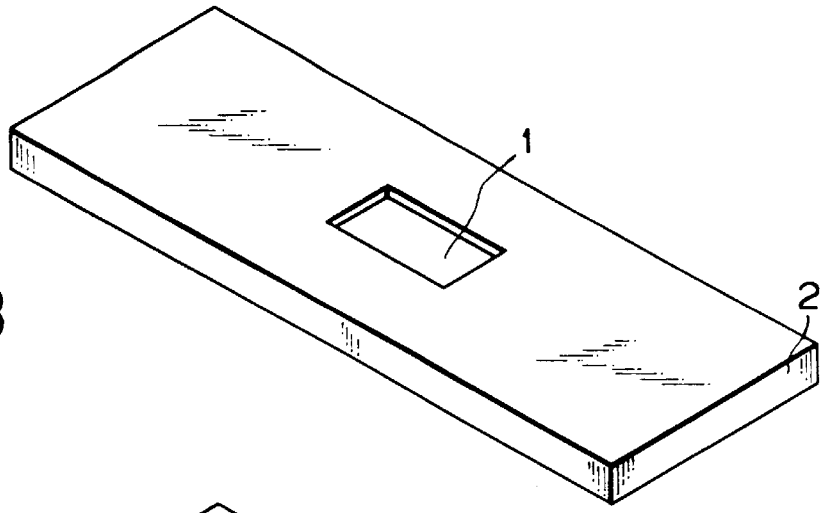
FIGS. 3, 4 and 5 are perspective views of a supporting member constituting a liquid ejecting head constructed according to a third embodiment of the present invention, particularly showing three supporting members each having a supporting portion formed thereon.
Figure 4:
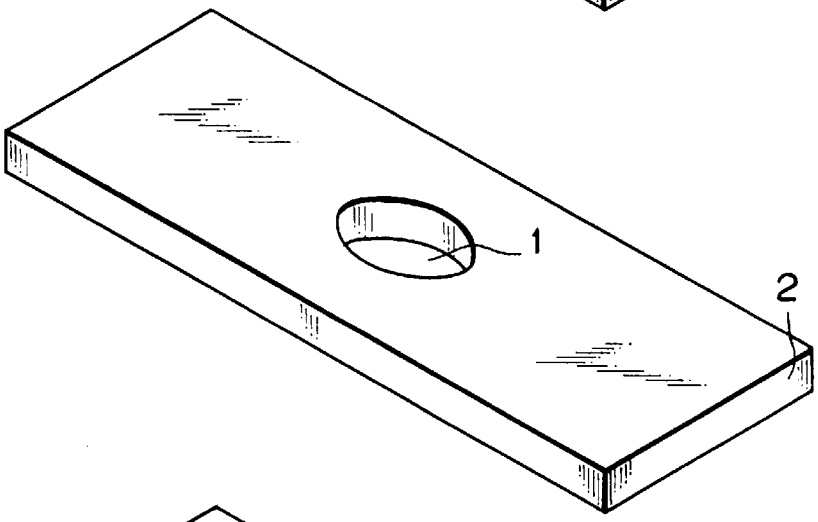
Figure 5:
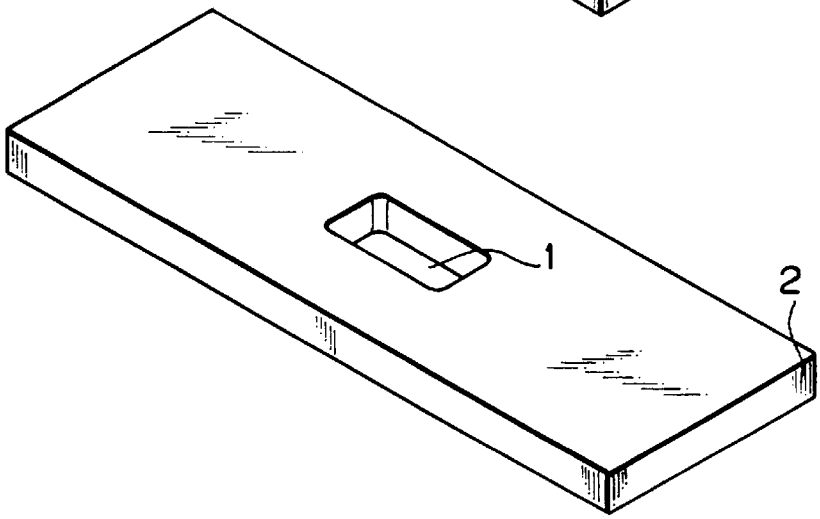

FIGS. 3, 4 and 5 show by way of perspective views the structure of an opening portion 1 formed through a supporting member 2 constituting a liquid ejecting head constructed according to a third embodiment of the present invention, respectively. In the preceding embodiment, the opening portion 1 is designed in the form of a rectangular opening. However, the present invention should not be limited only to this. Alternatively, as shown in FIG. 4, the opening portion 1 may be designed in the form of a circular or elliptical opening. Otherwise, as shown in FIG. 5, the opening portion 1 may be designed in the form of a rectangular opening of which four corners are rounded. When the opening portion 1 is designed in the above-described manner, the extent of stress concentration caused at the corner portion of a part of the grooved plate 3 attributable to thermal expansion or contraction after it is inserted into the supporting portion serving as an opening portion 1 can be reduced. Thus, there is no possibility that crack or fracture occurs with the grooved plate 3.

To assure that the supporting member 2 is reliably connected to the resin layer 5, it is desirable that the opening portion 1 is designed in the form of a through opening. However, the present invention should not be limited only to this. Alternatively, as shown in FIG. 3, the opening portion 1 may be designed in the form of a rectangular recess. In the case shown in FIG. 3, a grooved plate 3 is arranged on the surface of the supporting member 2 having the foregoing opening portion 1 formed thereon.

In each of the aforementioned embodiments, description has been made with respect to the case that an opening portion 1 is formed on the supporting member 2. However, in the case that the supporting member 2 is easily connected to the resin material having a plurality of liquid paths 4 each designed in the form of a groove formed thereon or in the case that each supporting member 2 is coated with a coupling material such as a silane coupling material or the like or a number of fine concavities and convexities are formed on the surface of the supporting member 2 by employing a sand blasting process so as to assure that the foregoing components are easily connected to each other, the provision of the supporting portion is not always required.

Figure 6:
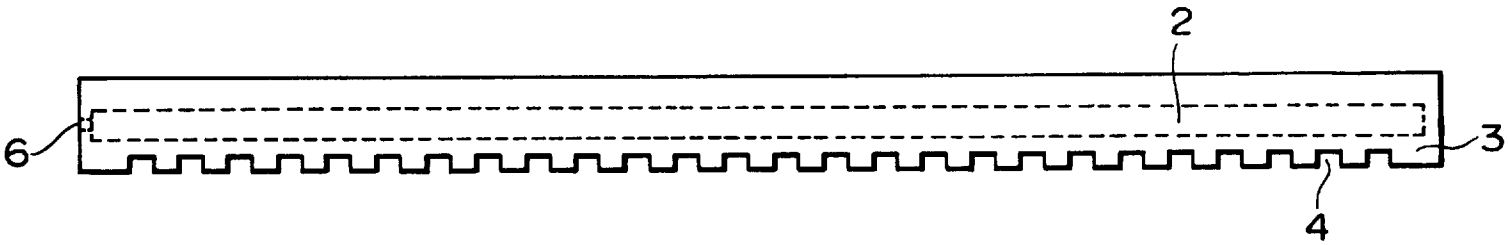
FIG. 6 is a side view of a grooved member constituting a liquid ejecting head constructed according to a modified embodiment of the present invention.

In addition, in each of the aforementioned embodiments, description has been made with respect to the case that the supporting member 2 is exposed to the outside for the purpose of simplification of description. Alternatively, as shown in FIG. 6, the whole supporting member 2 may be covered with a resin material constituting a grooved plate 3 and a resin layer. Otherwise, a part 6 of the supporting member 2 on the left-hand end side of the latter may be exposed to the outside.

In such manner, the closely connected state between the supporting member 2 and the resin material can be improved by covering the opposite ends of the supporting member 2 with the resin material as far as possible.

Figure 7:
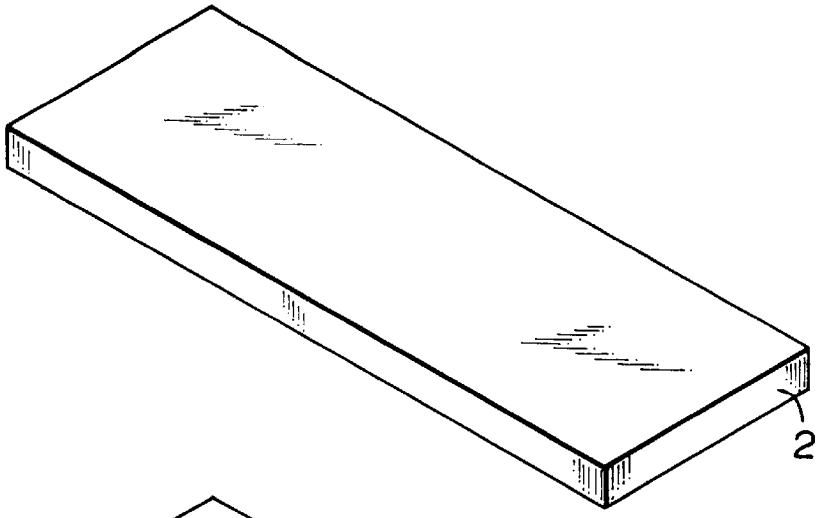
FIGS. 7, 8 and 9 are perspective views of a grooved member and associated components each constituting a liquid ejecting head, particularly illustrating a method of producing the foregoing grooved member according to a fourth embodiment of the present invention.

Next, a method of producing a grooved member constituting a liquid ejecting head constructed according to a fourth embodiment of the present invention will be described below with reference to FIGS. 7, 8 and 9.

Figure 8:
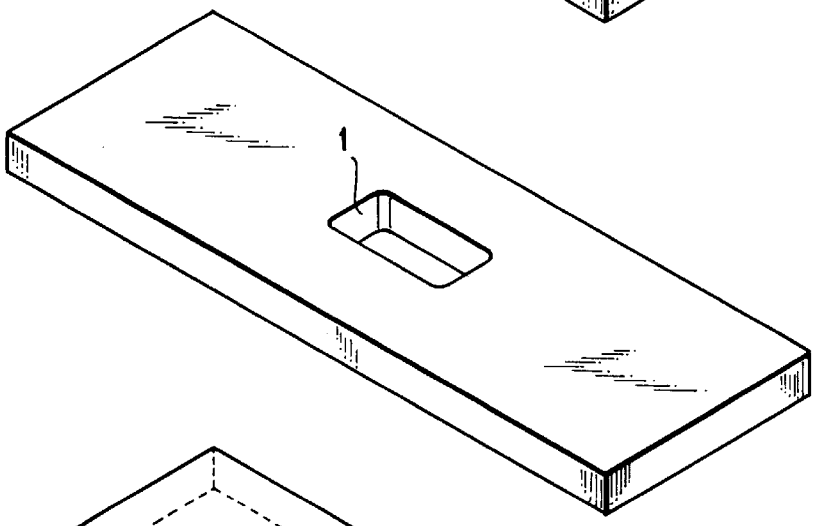

First, an opening portion 1 serving as a supporting portion is formed through a plate-shaped member made of glass or the like (see FIG. 7), whereby a supporting member 2 having the opening portion 1 formed therethrough is prepared (see FIG. 8).

Figure 9:
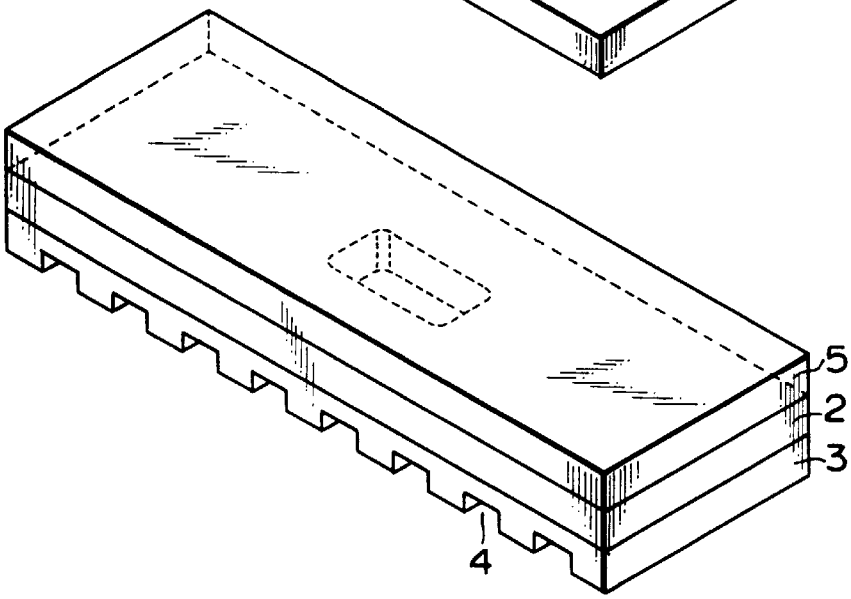

Subsequently, the supporting member 2 is placed above a die made of a photosensitive resin, a metallic material or the like, and thereafter, a grooved member having the supporting member 2 interposed between a grooved plate 3 having liquid paths 4 and a resin layer 5 is produced as shown in FIG. 9 by employing a hitherto known process such as a curtain coating process, a roll coating process, a spraying process, a molding process or the like.

Also in this embodiment, description has been made with respect to the case that all the end surfaces of the supporting member 2 are exposed to the outside. Alternatively, the end surfaces of the supporting member 2 may be covered with a resin in the same manner as mentioned above.

Next, a method of producing a grooved member constituting a liquid ejecting head constructed according to a fifth embodiment of the present invention will be described below with reference to FIGS. 10 and 11.

Figure 10:
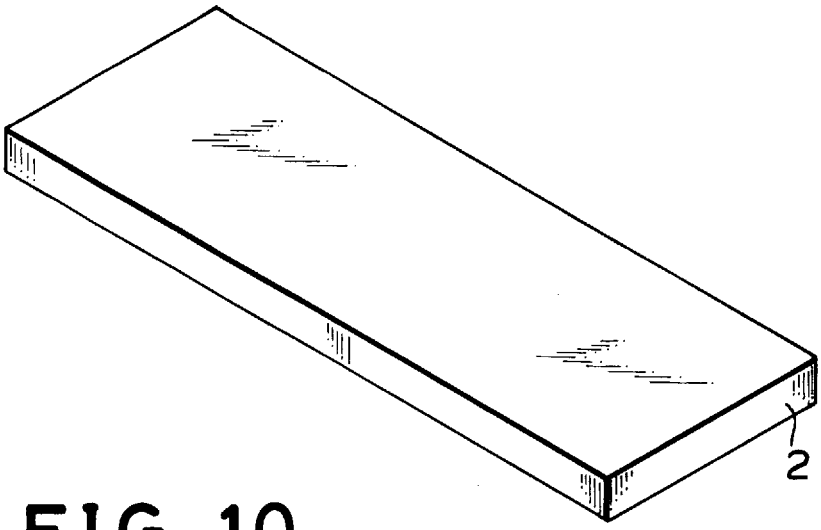
FIGS. 10 and 11 are perspective views of a grooved member and an associated component each constituting a liquid ejecting head, particularly illustrating a method of producing the foregoing grooved member according to a fifth embodiment of the present invention.
Figure 11:
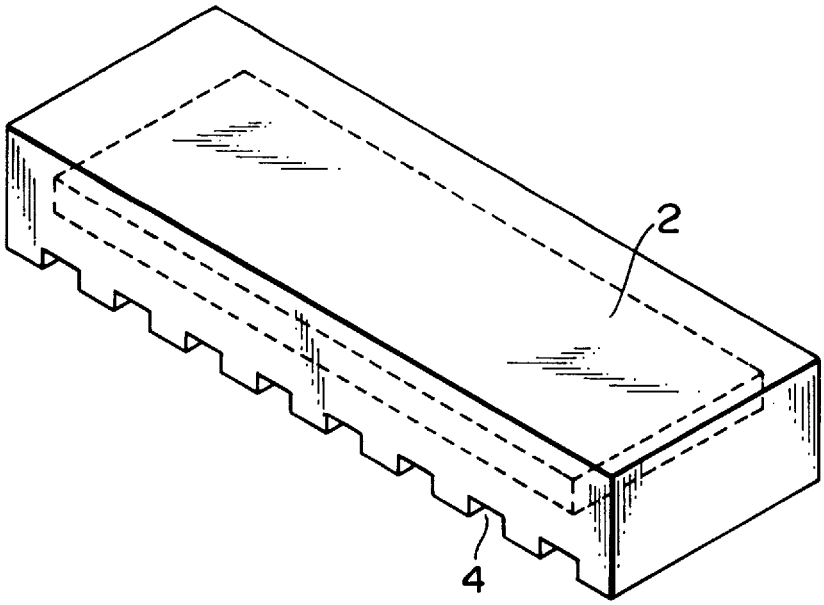

First, a supporting member 2 made of a metallic material is coated with a silane coupling material or a number of fine concavities and convexities are formed on whole surface of the supporting member 2 by employing a sand blasting process or the like (see FIG. 10).

Subsequently, the supporting member 2 is covered with a resin, and at the same time, a plurality of liquid paths 4 each designed in the form of a groove are formed by employing a hitherto known process such as a molding process or the like, whereby a grooved member is produced (see FIG. 11).

Since a plurality of grooves each serving as a liquid path 4 are formed at the same time, a whole of the supporting member 2 is enclosed with the resin or a part of the supporting member 2 is covered with the resin, advantageous effects of the present invention are such that a liquid ejecting head can easily be produced at an inexpensive cost, and moreover, adhesiveness properties of the supporting member 2 relative to the resin layer can be improved.

In this embodiment, the method has been described above with respect to the case where only the grooves each serving as a liquid path 4 are simultaneously formed on the grooved member. Otherwise, a common liquid chamber for supplying liquid to the respective liquid paths may simultaneously be formed in the grooved member.

In this case, it is recommendable that the supporting member 2 is formed at least at a part of the region corresponding to each liquid path 4 where dislocation to the base plate is unacceptable.

In the case that not only a plurality of grooves each serving as a liquid path 4 but also a common liquid chamber are simultaneously formed on the supporting member, a liquid ejecting head can more easily be produced at a reduced cost by practicing the method of the present invention as mentioned above.

Next, a liquid ejecting head constructed according to a sixth embodiment of the present invention will be described below with reference to FIGS. 12 and 13.

A liquid ejecting head 60 is produced while a plurality of liquid paths are formed thereon by securing the aforementioned grooved member to a base plate including a liquid ejecting element such as an electrothermal converting element adapted to apply thermal energy to liquid, an electrothermal converting element adapted to apply mechanical vibration to recording liquid or the like on a substrate made of glass, silicon, ceramics, metallic material or the like.

Figure 12:
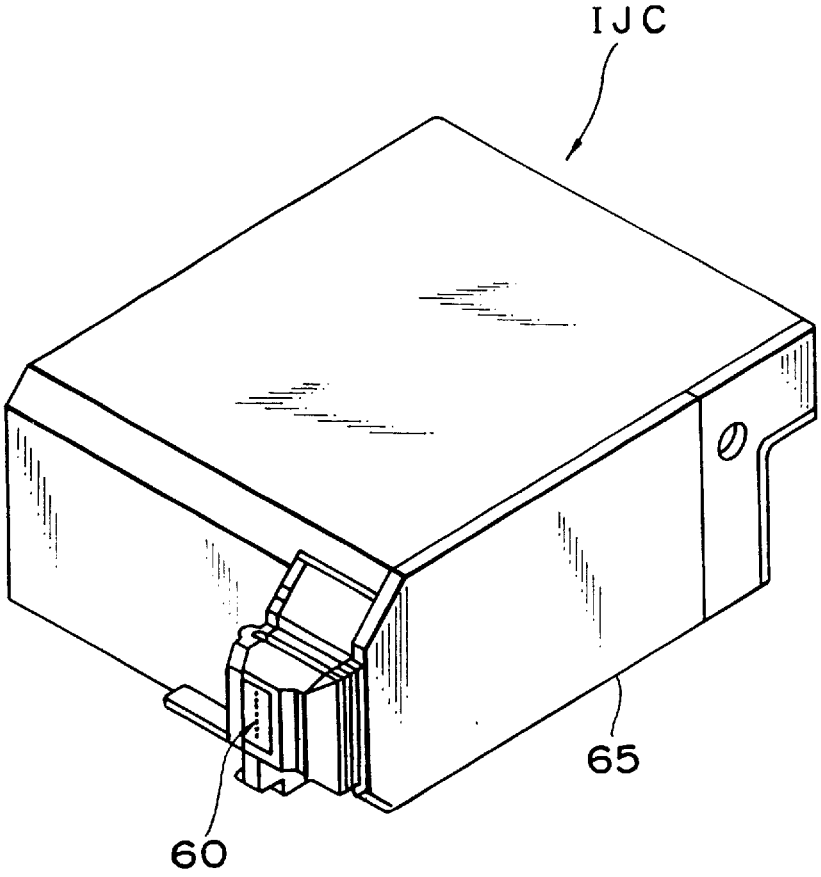
FIG. 12 is a perspective view of an ink jet cartridge having the liquid ejecting head of the present invention employed therefor.

FIG. 12 shows by way of perspective view the structure of an ink jet cartridge IJC having the aforementioned ink ejecting head 60 employed therefor. This ink jet cartridge IJC includes an ink ejecting head 60 and an ink tank 65 integrated with the ink ejecting head 60 while storing ink to be supplied to the ink ejecting head 60 therein.

Figure 13:
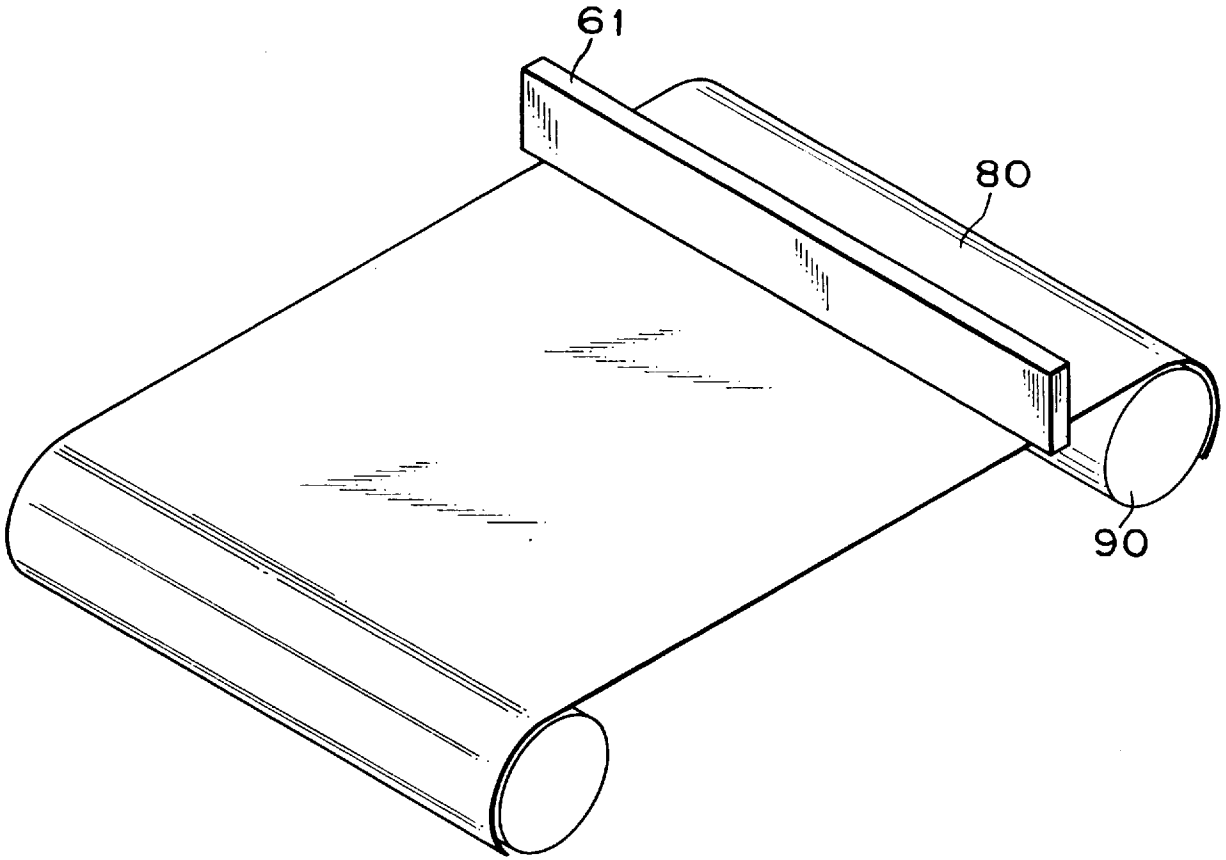
FIG. 13 is a schematic perspective view of a recording apparatus constructed according to a six embodiment of the present invention wherein a full line liquid ejecting head is mounted on the recording apparatus.

FIG. 13 shows by way of schematic perspective view the structure of a recording apparatus constructed according to a sixth embodiment of the present invention wherein a so-called full line liquid ejecting head 61 having a width coincident with the recordable width of a recording medium such as recording paper, cloth or the like is mounted on the recording apparatus.

In FIG. 13, reference numeral 61 designates a full line liquid ejecting head. This liquid ejecting head 61 serves to eject ink toward a recording medium 80 such as recording paper, cloth or the like which is stepwise conveyed by a recording medium conveying roller 90 so as to allow a recording operation to be performed with the liquid ejecting head 61. In this embodiment, since a quality of recorded image is not deteriorated owing to the arrangement of the full line recording head having a long length, recorded images each having a high quality can be obtained with the liquid ejecting head 61. It is confirmed that the liquid ejecting head 61 having a length of 30 mm or more as measured in the direction of arrangement of a row of heat generating resistors is advantageously employable for the recording apparatus, and moreover, the liquid ejecting head 61 having a length in excess of 60 mm as measured in the foregoing direction is more advantageously employable for the recording apparatus.

Figure 14:
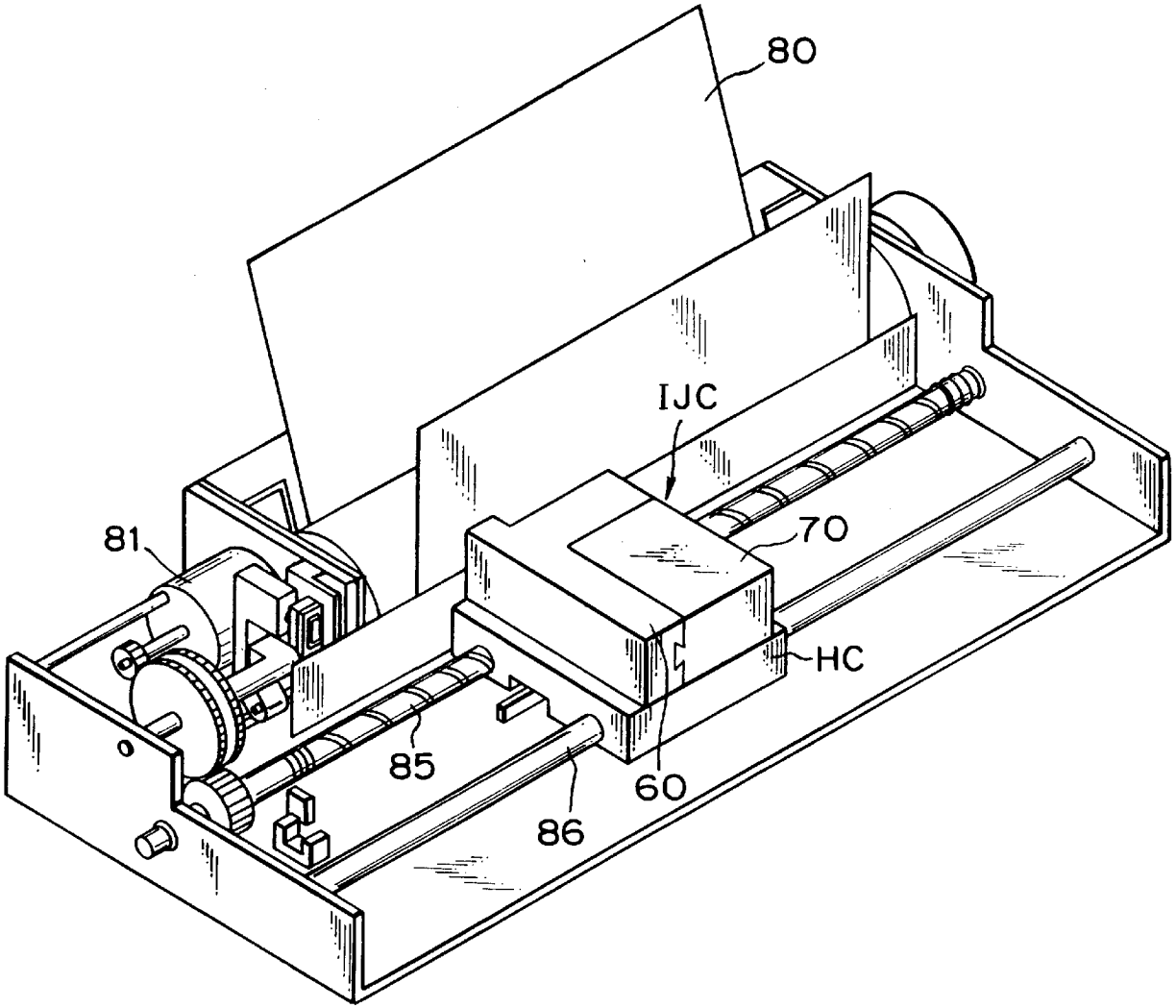
FIG. 14 is a perspective view of a recording apparatus constructed according to a seventh embodiment of the present invention wherein an ink jet cartridge is mounted on the recording apparatus.
Figure 15:
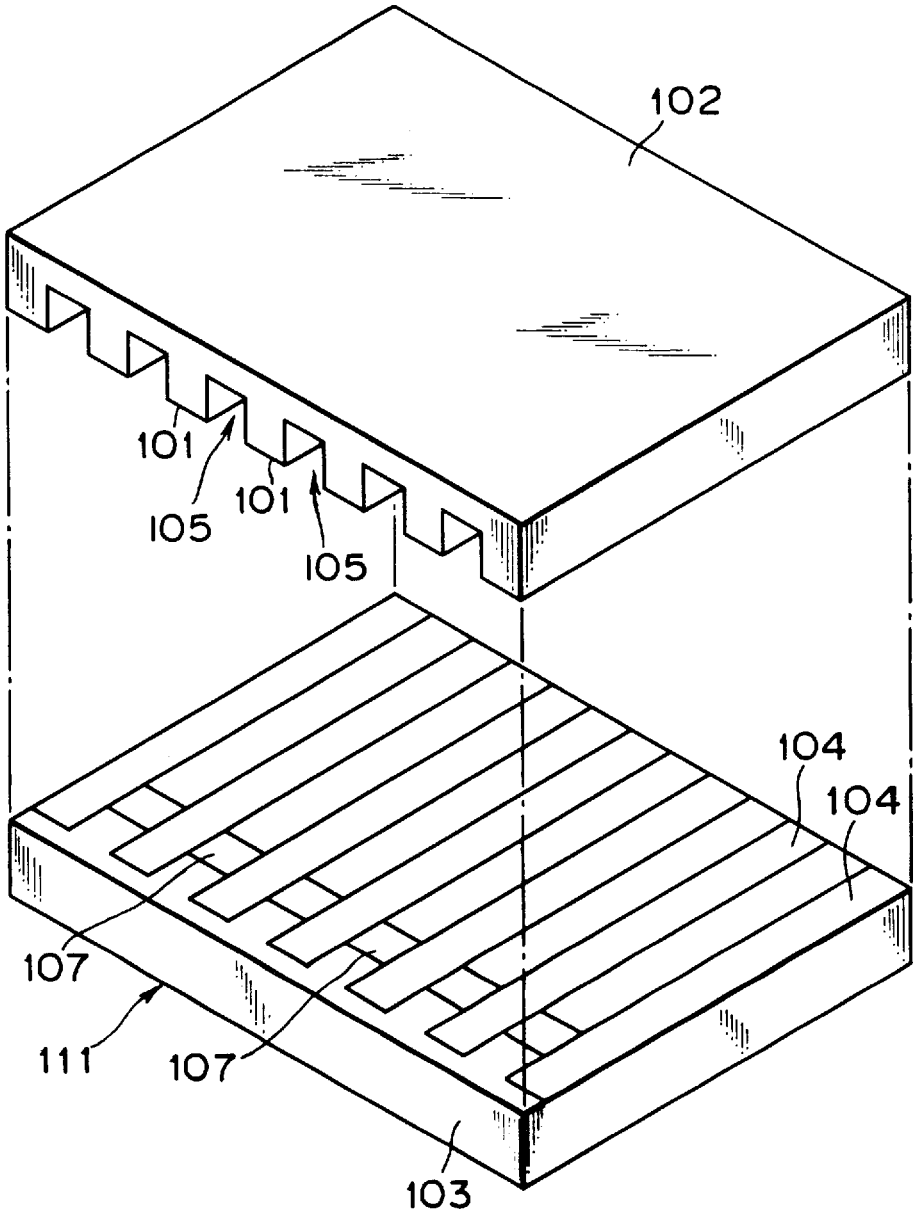
FIG. 15 (PRIOR ART)
FIG. 15 is a schematic perspective view of a conventional liquid ejecting head, particularly showing essential components constituting the liquid ejecting head in the disassembled state.
Figure 16:
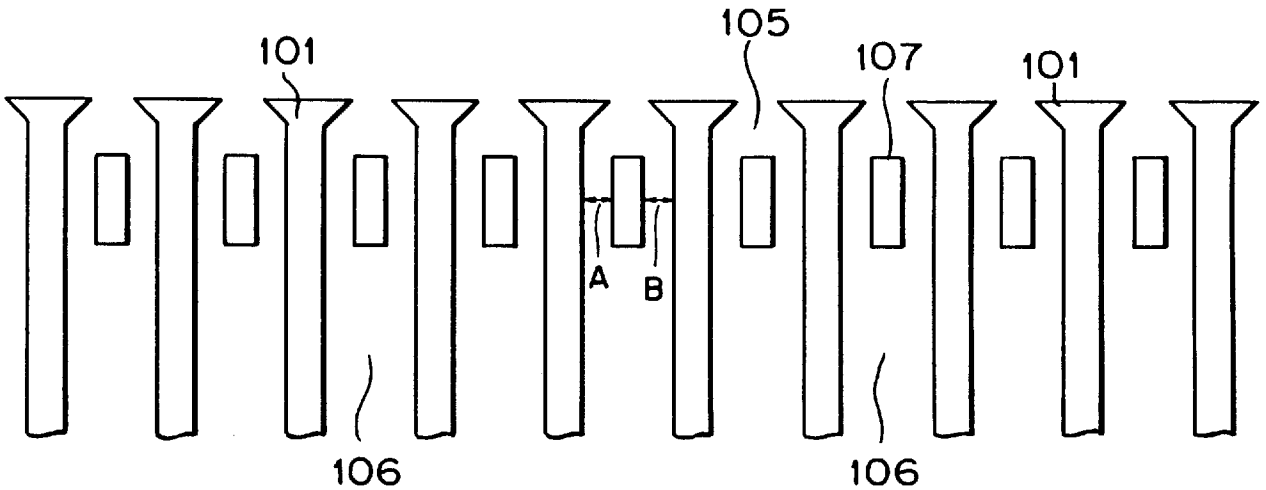
FIG. 16 (PRIOR ART)
FIGS. 16 and 17 are illustrative views of a base plate and a grooved member each constituting the conventional liquid ejecting head, particularly
Figure 17:
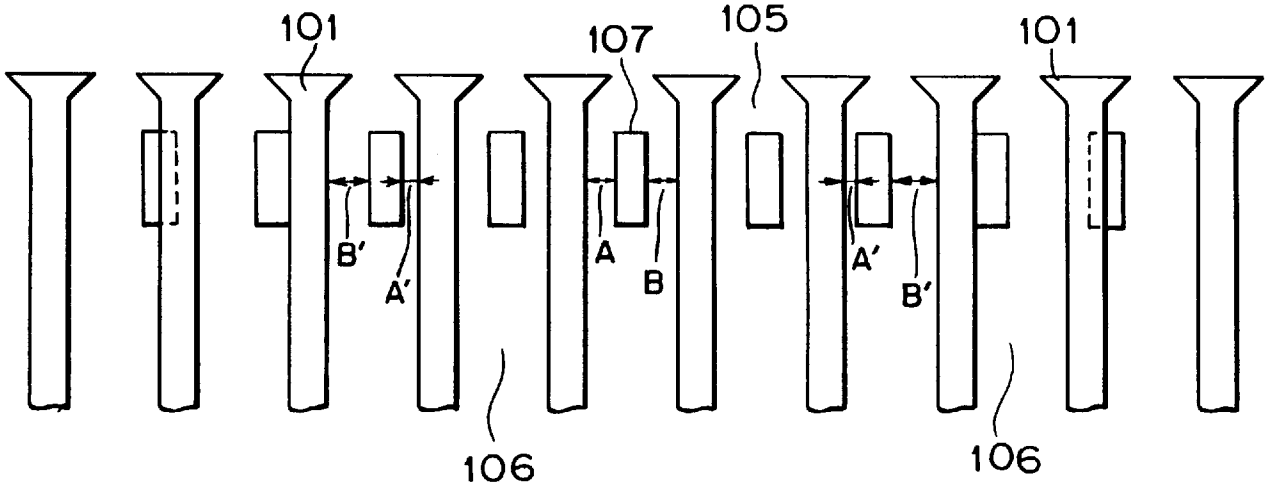
FIG. 17 (PRIOR ART)

FIG. 14 shows by way of perspective view the structure of a recording apparatus constructed according to a seventh embodiment of the present invention wherein a small-sized liquid ejecting head is mounted on the recording apparatus. With the recording apparatus constructed as shown in FIG. 14, an ink jet cartridge IJC including an ink ejecting head 60 and an ink tank section 70 detachably fitted to the ink ejecting head 60 is mounted on a carriage HC. In addition to the carriage HC, the recording apparatus includes a motor 81 serving as a driving power source for rotationally driving a conveying roller and associated components so as to convey a recording medium 80 such as recording paper, cloth or the like and a carriage feed shaft 85 serving to transmit the driving power generated by the driving power source to the carriage HC. Additionally, the recording apparatus includes a signal outputting unit (not shown) for outputting a series of signals for ejecting ink toward the recording medium 80.

In this embodiment, especially in connection with the ink jet recording system, the recording apparatus includes means (e.g., an electrothermal converting element, a laser light beam or the like) for generating thermal energy as energy to be utilized for the purpose of ink ejection. When a liquid ejecting head of the type adapted to induce variation of the ink state by utilizing the thermal energy is mounted on the recording apparatus, the latter exhibits excellent advantageous effects because each recording operation can be achieved with the recording head of the foregoing type not only at a higher density but also at a higher accuracy.

With respect to a typical structure of the recording head of the foregoing type and a principle of operation of the same, it is recommendable that reference is made to U.S. Pat. No. 4,723,129 and U.S. Pat. No. 4,740,796. The fundamental principle disclosed in these official gazettes is applicable to either of a so-called on-demand type liquid ejecting head and a continuous type liquid ejecting head. Especially, in the case of the on-demand type liquid ejecting head, when at least a single driving signal is applied to an electrothermal converting element disposed corresponding to a sheet and a liquid path each having a recording liquid held thereon so as to quickly elevate the temperature of the recording liquid in excess of appearance of a phenomenon of film boiling, thermal energy is generated by the electrothermal converting element so that the phenomenon of film boiling appears on the thermal working surface of the liquid ejecting head, causing a bubble to be formed in the recording liquid in response to the driving signal. As the bubble grows or contracts, the recording liquid is ejected through an ejecting port to form at least a single liquid droplet. Since the bubble adequately grows and contracts when the driving signal is generated in the form of a pulse, recording liquid ejection can be achieved with highly excellent responsiveness. For this reason, liquid ejection of the foregoing type is more preferably acceptable. With respect to the pulse-shaped driving signal, it is recommendable that reference is made to U.S. Pat. No. 4,463,359 and U.S. Pat. No. 4,345,262. When conditions associated with the temperature raising rate of a temperature on the thermal working surface of the liquid ejecting head as disclosed in U.S. Pat. No. 4,313,124 are employed for the liquid ejecting head, each recording operation can be achieved with more excellent results.

With respect to the structure of the liquid ejecting head, it is recommendable that reference is made to U.S. Pat. No. 4,558,333 and U.S. Pat. No. 4,459,600 which disclose the technical concept that the thermal working portion of the liquid ejecting head is disposed in the bent region, in addition to the combined structure made among injection ports, a liquid path (a linearly extending liquid path or a liquid path extending at a right angle relative to two liquid path portions thereof) and an electrothermal converting element as disclosed in the aforementioned prior inventions. In addition, with respect to the structure of a plurality of electrothermal converting element each including a common slit as an ejecting portion, it is recommendable that reference is made to an official gazette of Japanese Patent Application Laying-Open No. 123670/1984. Additionally, with respect of the structure for forming an opening portion for absorbing a pressure wave of thermal energy corresponding to an ejecting portion, it is recommendable that reference is made to Japanese Patent Application Laying-Open No. 138461/1984. Conclusively, according to the present invention, each recording operation can reliably be performed at a high efficiency.

In addition, the present invention is advantageously applicable to a full line type liquid ejecting head having a width corresponding to a maximum recordable width of a recording medium such as recording paper, cloth or the like. This type of liquid ejecting head may be constructed such that the whole length of the liquid ejecting head is composed of lengths of a plurality of liquid ejecting heads to be combined with each other. Alternatively, the liquid ejecting head may be constructed such that the whole length of the liquid ejecting head is composed of a length of a single liquid ejecting head designed in the integral structure.

Additionally, the present invention is likewise advantageously applicable to a serial type liquid ejecting head constructed in the form of a liquid ejecting head fixedly secured to a main body of the recording apparatus, an exchangeable tip type liquid ejecting head constructed such that the it can electrically be connected to the main body of the recording apparatus, and moreover, recording liquid can be supplied to the liquid ejecting head from the main body of the recording apparatus or a cartridge type liquid ejecting head having a recording liquid tank integrated therewith.

With the recording apparatus constructed according to the present invention, it is preferable from the viewpoint of stably exhibiting the advantageous effects of the present invention that it is additionally equipped with an activating unit for activating the liquid ejecting head and a preliminary auxiliary unit. Specifically, the activating unit and the preliminary auxiliary unit are exemplified by capping means effective for the liquid ejecting head, cleaning means, pressurizing or evacuating means, an electrothermal converting element, a heating element disposed independently of the electrothermal converting element, preliminary heating means for heating the electrothermal converting element and the heating element in the combined state, and preliminary liquid ejecting means for ejecting liquid independently of a recording operation.

With respect to the kind of liquid ejecting heads to be mounted on the recording apparatus and the number of the same, e.g., a single liquid ejecting head is mounted on the recording apparatus corresponding to a monochromatic recording liquid. Alternatively, a plurality of liquid ejecting heads are mounted on the recording apparatus corresponding to a plurality of recording liquids each exhibiting a different color and having a different concentration. In other words, a recording mode to be employed for the recording apparatus should not be limited only to a single recording mode corresponding to a monochromatic recording liquid having, e.g., a black color. Alternatively, a plurality of recording modes may be employed for the recording apparatus corresponding to plural kinds of recording liquids each having a different color or exhibiting a full color with the mixed recording liquids.

In each of the aforementioned embodiments, description has been made on the assumption that recording liquid to be ejected from the liquid ejecting head is prepared in the form of a liquid. Alternatively, the recording liquid may be such that it is kept solid at a room temperature or at a temperature lower than the room temperature but it is softened or liquidified at the room temperature. In the case of the ink jet recording system, since the temperature of the recording liquid is usually controlled such that the viscosity of the recording liquid is maintained within the stable ejecting range by properly regulating the temperature of the recording liquid itself within the range from 30° C. or more to 70° C. or less, the recording liquid may be such that it is kept liquid when a recording operation command signal is inputted into the liquid ejecting head. In addition, to prevent the temperature of the recording liquid from being excessively raised up by utilizing thermal energy for changing the solid state of the recording liquid to the liquid state of the same or to prevent the recording liquid from being vaporized, the recording liquid may be such that it is kept solid while it is not used but it is liquidized as it is heated. At any rate, the present invention can be applied to the case that recording liquid is liquidized by thermal energy in response to a recording operation command signal so as to allow it to be ejected from the liquid ejecting head or the case that each ejected recording liquid droplet starts to be solidified when it reaches a recording medium such as recording paper, cloth or the like. With respect to the recording liquid of the foregoing type, it is recommendable that reference is made to Japanese Patent Application Laying-Open Nos. 56847/1979 and 71260/1985 each of which discloses the technical concept that ink faces to an electrothermal converting element while it is held in a number of concavities or fine through holes formed through a sheet of porous material. To carry out the present invention, it is most advantageous that a film boiling process is executed for the purpose of recording liquid ejection.

According to the present invention, it is acceptable that an ink jet recording apparatus is practically used as an image output terminal apparatus for information processing equipment such as a computer or the like. In addition, the ink jet recording apparatus may be constructed in the form of an electronic copying apparatus electrically combined with an optical reader or a facsimile apparatus having a signal sending/receiving function.

Additionally, the present invention may be applied to a textile printing apparatus or a textile printing system which is additionally equipped with a textile printing apparatus, a preliminary treatment apparatus and an aftertreatment apparatus.

Further, according to the present invention, a liquid ejecting head can be provided in the form of a recording head not only without dislocation of each liquid path relative to the corresponding liquid ejecting element disposed on a base plate but also without an occurrence of malfunction that recording liquid is incorrectly ejected from the liquid ejecting head in the curved state or it fails to be ejected from the liquid ejecting head even when the latter is used in an environment having a high temperature.

Additionally, according to the present invention, a liquid ejecting head having a large length can be provided without any possibility of incorrect or irregular printing for a textile printing apparatus having an earnest request raised for providing a long liquid ejecting head or a textile printing system including a printing apparatus, a preliminary treatment apparatus and an aftertreatment apparatus. Thus, a textile printing apparatus and a textile printing system which make it possible to record images each having a high quality can be provided.

Finally, according to the present invention, a method of producing a liquid ejecting head by way of simple steps without any possibility that recording liquid is incorrectly ejected from the liquid ejecting head in the curved state or recording liquid fails to be ejected from the same can be provided.

While the present invention has been described above with respect to several preferred embodiments thereof, it should of course be understood that the present invention should not be limited only to these embodiments but various change or modification may be made any departure from the scope of the present invention as defined in the appended claims.

What is claimed is:

1. A liquid ejecting head for ejecting a liquid, comprising:

a base plate having a plurality of liquid ejecting elements for ejecting the liquid; and a grooved member having a plurality of grooves constituting a plurality of liquid paths formed thereon corresponding to said liquid ejecting elements, said grooved member being connected to said base plate and composed of a grooved element made of a material having a thermal expansion coefficient and having said grooves formed thereon and a supporting member for supporting said grooved element thereon, said supporting member comprising a material having a thermal expansion coefficient that is lower than that of the material constituting said grooved element.

2. The liquid ejecting head as claimed in claim 1, wherein said supporting member includes a plurality of supporting portions, and a resin layer is arranged only on one surface of said supporting member, said resin layer being connected to said grooved element via said supporting portions.

3. A liquid ejecting head as in claim 1, wherein said grooved element comprises a polysulfone resin or a polyether sulfone resin.

4. A liquid ejecting head as in claim 1, wherein said supporting member is in a shape of a planar plate.

5. A liquid ejecting head as in claim 4, wherein said grooved element is arranged on a one surface of said supporting member and a resin layer is provided on an other surface opposite to said surface.

6. A liquid ejecting head as in claim 5, wherein each of said grooved element and said resin layer is not more than 60 $\mu$m in thickness.

7. The liquid ejecting head as claimed in claim 5, wherein said supporting member includes a plurality of supporting portions, and said grooved element is connected to said resin layer via said supporting portions.

8. The liquid ejecting head as claimed in claim 1, wherein said supporting member has a thermal expansion coefficient approximately equal to that of said base plate.

9. A liquid ejecting head as in claim 1, wherein a concave portion forming a common liquid chamber to supply a liquid to a plurality of liquid paths is integrally formed in said grooved element.

10. A liquid ejecting head as in claim 1, wherein said base plate and said grooved member are separate members, and are connected to each other to thereby form said liquid paths.

11. A liquid ejecting head as in claim 1, wherein said liquid ejecting head is an ink jet recording head which records using an ink as the liquid.

12. A liquid ejecting head for electing a liquid comprising:

a base plate having a plurality of liquid ejecting elements for ejecting the liquid;

a grooved member having a supporting member having a plurality of grooves constituting a plurality of liquid paths formed thereon corresponding to said liquid ejecting elements, and said supporting member being embedded with said resin member.

13. The liquid ejecting head as claimed in claim 1 or claim 12, wherein said liquid ejecting head is prepared in the form of a full line type head.

14. A recording apparatus, comprising;

a liquid ejecting head as claimed in claim 1 or claim 12; and signal supplying means for supplying a series of signals to said liquid ejecting head so as to activate a plurality of liquid ejecting elements.

15. A liquid ejecting head as in claim 1 or claim 12, wherein said supporting member comprises a metal.

16. A liquid ejecting head as in claim 1 or claim 12, wherein said ejected liquid is an ink.

17. A liquid ejecting head as in claim 1 or claim 12, wherein a coupling agent is coated on said supporting member.

18. A liquid ejecting head as in claim 1 or claim 2, wherein said ejecting element is an electrothermal transducer which generates heat in accordance with an electric signal.

19. A liquid ejecting head as in claim 1 or claim 12, wherein said liquid ejecting head is at least 30 mm in length.

20. A liquid ejecting head as in claim 1 or claim 12, wherein said liquid ejecting head is at least 60 mm in length.

21. A liquid ejecting head as in claim 12, wherein said supporting member is partially exposed from said resin member.

22. A liquid ejecting head as in claim 12, wherein said resin member comprises a polysulfone resin or a polyether sulfone resin.

23. A liquid ejecting head as in claim 12, wherein said supporting member is in a shape of a planar plate.

24. A liquid ejecting head as in claim 23, wherein said resin member is arranged on a one surface of said supporting member and a resin layer is provided on an other surface opposite to said surface.

25. A liquid ejecting head as in claim 24, wherein said supporting member includes a plurality of supporting portions and said resin member is connected to said resin layer via said plurality of supporting portions.

26. A liquid ejecting head as in claim 12, wherein a concave portion constituting a common liquid chamber for supplying a liquid to a plurality of liquid paths is integrally formed in said resin element.

27. A liquid ejecting head cartridge, comprising:

a liquid ejecting head as in claim 1 or claim 12; and a container for holding a liquid supplied to said liquid ejecting head.

28. A liquid ejecting head cartridge as in claim 27, wherein said liquid is an ink.

29. A liquid ejecting head as in claim 12, wherein said base plate and said grooved member are separate members, and are connected to each other to thereby form said liquid paths.

30. A liquid ejecting head as in claim 12, wherein said liquid ejecting head is an ink jet recording head which records using an ink as the liquid.

31. A liquid ejecting head as claimed in claim 12, wherein said supporting member comprises a material having a thermal expansion coefficient that is lower than that of a material constituting said grooved element.

32. The liquid ejecting head according to claims 1 or 12, wherein said grooved member contacts directly with said supporting member.

33. A method of producing a liquid ejecting head including a base plate having a plurality of liquid ejecting elements for ejecting liquid, and a grooved member having a plurality of grooves each constituting a plurality of liquid paths formed thereon corresponding to said liquid ejecting elements, said grooved member being connected to said base plate, comprising the steps of:

preparing a base plate having said liquid ejecting elements;

forming a plurality of supporting portions on a supporting member;

forming said grooved member by forming a grooved element on one side of said supporting member, forming a resin member on an other side of the same, and then connecting said grooved element to said resin member via said supporting portions; and connecting said base plate to said grooved member.

34. A method as in claim 33, wherein said resin member and said grooved element comprise a polysulfone resin or a polyether sulfone resin.

35. A method of producing a liquid ejecting head including a base plate having a plurality of liquid ejecting elements for ejecting a liquid, and a grooved member made of a material having a thermal expansion coefficient and having a plurality of grooves, respective ones of which constitute a plurality of liquid paths formed thereon corresponding to said liquid ejecting elements, said grooved member being connected to said base plate, comprising the steps of:

preparing a base plate having said liquid ejecting elements;

preparing a supporting member which is composed of a material with a thermal expansion coefficient that is lower than that of the material constituting said grooved member; and forming said grooved member by covering said supporting member with a resin material and integrally forming said grooves each constituting a liquid path in said resin material; and connecting said base plate to said grooved member.

36. A method of producing a liquid ejecting head including a base plate having a plurality of liquid ejecting elements for ejecting a liquid and a grooved member having a plurality of grooves, respective ones of which constitute a plurality of liquid paths formed thereon corresponding to said liquid ejecting elements, said grooved member being connected to said base plate, said method comprising the steps of:

preparing a base plate having said liquid ejecting elements;

preparing a supporting member; and embedding said supporting member with resin material and integrally forming grooves constituting said plurality of liquid paths with said resin material to form said grooved member.

37. A method as in claim 35 or claim 36, wherein said resin material comprises a polysulfone resin or a polyether sulfone resin.

38. A method as in claim 36, wherein said supporting member is partially exposed from said resin material.

39. A method as in any of claims 33, 35, or 36, wherein said supporting member comprises a metal.

40. The method as claimed in claim 33, 35, or 36, further including a step of allowing said supporting member to be subjected to surface treatment so as to improve adhesiveness properties of said supporting member relative to said resin material.

41. A method of producing a liquid ejecting head including a base plate having a plurality of liquid ejecting elements for ejecting a liquid and a grooved member having a plurality of liquid paths formed thereon corresponding to said liquid ejecting elements, said method comprising the steps of:

preparing said base plate having said liquid ejecting elements;

preparing a grooved member having a plurality of grooves constituting said plurality of liquid paths formed thereon corresponding to said liquid ejecting elements, said grooved member being composed of a grooved element made of a material having a thermal expansion coefficient and having said grooves formed thereon and a supporting member for supporting said grooved element thereon, said supporting member including a material having a thermal expansion coefficient that is lower than the thermal expansion coefficient of the material constituting said grooved element; and connecting said base plate to said grooved member, to thereby form said plurality of liquid paths.

42. A method as in claim 41, wherein said liquid ejecting head is an electro-thermal transducer which generates heat.

* * * * *

UNITED STATES PATENT AND TRADEMARK OFFICE

CERTIFICATE OF CORRECTION

PATENT NO. : 5,774,151

DATED : June 30, 1998

INVENTOR(S): HIROSHI SUGITANI, ET AL.

It is certified that error appears in the above-identified patent and that said Letters Patent is hereby corrected as shown below:

AT [57] ABSTRACT

Line 12, "supplying,a" should read --supplying a--;
Line 15, "practices" should read --practiced--;
Line 16, "a," should read --a--;
Line 17, "plurality,of" should read --plurality of--; and
Line 18, "grooves" should read --grooved--.

COLUMN 3

Line 7, "other" should read --another--; and
Line 8, "can not" should read --cannot--.

COLUMN 5

Line 29, "grooves" should read --grooved--.

COLUMN 8

Line 20, "few" should read --a slight--.

COLUMN 12

Line 11, "of" should read --to--.

UNITED STATES PATENT AND TRADEMARK OFFICE

CERTIFICATE OF CORRECTION

PATENT NO. : 5,774,151

DATED : June 30, 1998

INVENTOR(S): HIROSHI SUGITANI, ET AL.

It is certified that error appears in the above-identified patent and that said Letters Patent is hereby corrected as shown below:

COLUMN 14

Line 16, "change or modification" should read --changes or modifications--; and "any" should read --without any--.

COLUMN 15

Line 4, "member" (second occurrence) should read --member and a resin member, said resin member--; and Line 12, "comprising;" should read --comprising:--.

Signed and Sealed this

Sixteenth Day of March, 1999

*Attest:*

*Attesting Officer*

Q. TODD DICKINSON

*Acting Commissioner of Patents and Trademarks*